US012590742B2

(12) United States Patent
Kaji et al.

(10) Patent No.: US 12,590,742 B2
(45) Date of Patent: Mar. 31, 2026

(54) REFRIGERANT RECOVERY SYSTEM

(71) Applicant: DAIKIN INDUSTRIES, LTD., Osaka (JP)

(72) Inventors: Ryuhei Kaji, Osaka (JP); Eiji Kumakura, Osaka (JP); Atsushi Yoshimi, Osaka (JP); Masaki Tanaka, Osaka (JP); Hiroki Ueda, Osaka (JP); Masaki Nakayama, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 142 days.

(21) Appl. No.: 18/373,097

(22) Filed: Sep. 26, 2023

(65) Prior Publication Data

US 2024/0019183 A1 Jan. 18, 2024

Related U.S. Application Data

(63) Continuation of application No. PCT/JP2022/015195, filed on Mar. 28, 2022.

(30) Foreign Application Priority Data

Mar. 31, 2021 (JP) ..... 2021-061282

(51) Int. Cl.
*F25B 45/00* (2006.01)

(52) U.S. Cl.
CPC ..... *F25B 45/00* (2013.01)

(58) Field of Classification Search
CPC ..... F25B 45/00; F25B 49/005; F25B 9/008
See application file for complete search history.

(56) References Cited

U.S. PATENT DOCUMENTS

| | | | | |
|---|---|---|---|---|
| 4,998,413 | A | 3/1991 | Sato et al. | |
| 5,802,859 | A * | 9/1998 | Zugibe | G01G 17/06 62/149 |
| 6,141,977 | A * | 11/2000 | Zugibe | G01G 17/06 62/149 |
| 2004/0055317 | A1* | 3/2004 | Nomura | F25B 45/00 62/149 |
| 2009/0145143 | A1* | 6/2009 | McMasters | F25B 45/00 62/149 |

(Continued)

FOREIGN PATENT DOCUMENTS

| | | | | |
|---|---|---|---|---|
| EP | 1398618 | A2 * | 3/2004 | G01N 21/3504 |
| EP | 2529961 | A1 * | 12/2012 | B60H 1/00585 |

(Continued)

OTHER PUBLICATIONS

International Preliminary Report of corresponding PCT Application No. PCT/JP2022/015195 dated Oct. 12, 2023.

(Continued)

*Primary Examiner* — Kun Kai Ma
(74) *Attorney, Agent, or Firm* — Spencer Fane LLP

(57) ABSTRACT

A refrigerant recovery system includes a cylinder, a first detection unit, and a control unit. The cylinder accommodate a refrigerant filling a refrigeration cycle apparatus. The first detection unit detects a predetermined physical quantity in order to calculate a composition of the refrigerant accommodated in the cylinder. The control unit acquires a result of detection by the first detection unit and outputs the result as a first detection result.

12 Claims, 5 Drawing Sheets

(56) References Cited

U.S. PATENT DOCUMENTS

| | | | | |
|---|---|---|---|---|
| 2009/0241560 | A1* | 10/2009 | Murray | B60H 1/00585 62/77 |
| 2019/0003755 | A1 | 1/2019 | Crombie et al. | |
| 2020/0309431 | A1 | 10/2020 | Mimura et al. | |

FOREIGN PATENT DOCUMENTS

| | | | | |
|---|---|---|---|---|
| JP | 3-50469 | A | 3/1991 | |
| JP | 4-76122 | U | 7/1992 | |
| JP | 6-10765 | U | 2/1994 | |
| JP | 2002-213845 | A | 7/2002 | |
| JP | 2002-267232 | A | 9/2002 | |
| JP | 2004-116875 | A | 4/2004 | |
| JP | 2018-532091 | A | 11/2018 | |
| JP | 6573523 | B2 | 9/2019 | |
| JP | 2020-180746 | A | 11/2020 | |
| WO | WO-2013030121 | A1 * | 3/2013 | G01J 5/0862 |
| WO | 2019/111877 | A1 | 6/2019 | |

OTHER PUBLICATIONS

European Search Report of corresponding EP Application No. 22 78 0818.5 dated Aug. 16, 2024.
International Search Report of corresponding PCT Application No. PCT/JP2022/015195 dated May 31, 2022.

* cited by examiner

REFRIGERANT RECOVERY SYSTEM

CROSS-REFERENCE TO RELATED APPLICATIONS

This is a continuation of International Application No. PCT/JP2022/015195 filed on Mar. 28, 2022, which claims priority to Japanese Patent Application No. 2021-061282, filed on Mar. 31, 2021. The entire disclosures of these applications are incorporated by reference herein.

BACKGROUND

Technical Field

The present disclosure relates to a refrigerant recovery system.

Background Art

Japanese Unexamined Patent Application Publication (Translation of PCT Application No. 2018-532091) discloses a system that recovers a refrigerant of a refrigeration unit (refrigeration cycle apparatus) to reuse the refrigerant.

SUMMARY

A refrigerant recovery system includes a cylinder, a first detection unit, and a control unit. The cylinder accommodates a refrigerant filling a refrigeration cycle apparatus. The first detection unit detects a predetermined physical quantity for calculating a composition of the refrigerant accommodated in the cylinder. The control unit acquires a result of detection by the first detection unit and outputs the result as a first detection result.

DETAILED DESCRIPTION OF EMBODIMENT(S)

First Embodiment (1) Overall Configuration

A refrigerant recovery system 100 according to a first embodiment is a system that suppresses complication of an operation for recovering a refrigerant from a refrigeration cycle apparatus 500. The refrigeration cycle apparatus 500 is a device that provides a vapor compression refrigeration cycle using a refrigerant. The refrigeration cycle apparatus 500 is, for example, an air conditioning apparatus, an air purification apparatus, a heat pump hot water supply apparatus, a refrigeration apparatus, or a freezer apparatus. The refrigerant used in the refrigeration cycle apparatus 500 is a mixed refrigerant obtained by mixing a plurality of refrigerants at a predetermined composition ratio. The refrigerant used in the refrigeration cycle apparatus 500 contains, but not limited to, 2,3,3,3-tetrafluoropropene (HFO-1234yf) and carbon dioxide (R744) at a predetermined composition ratio.

Figure 1:
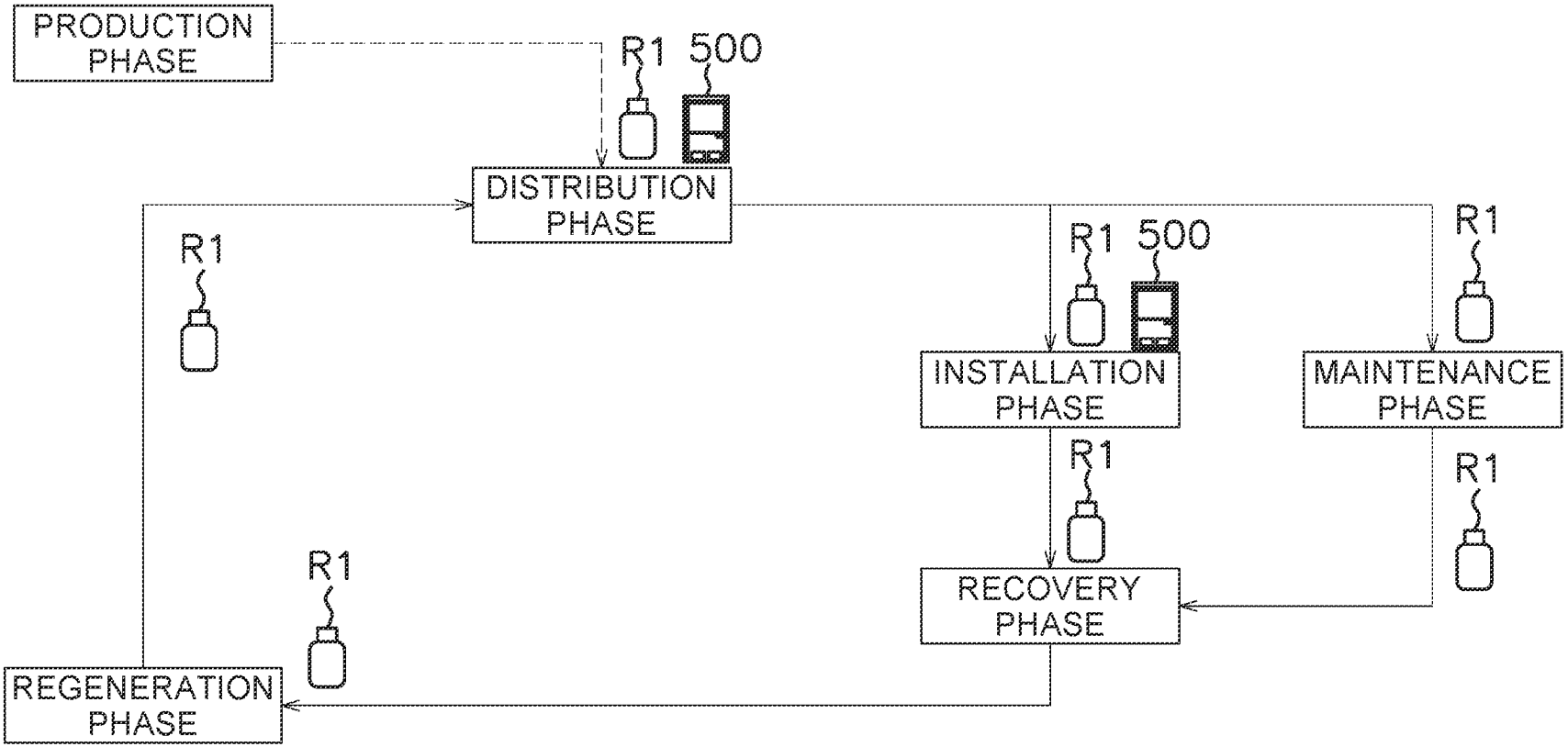
FIG. 1 is a diagram illustrating a schematic configuration of a refrigerant circulation cycle.

First, an overview of a refrigerant circulation cycle in which the refrigerant recovery system 100 is mainly used will be described. FIG. 1 is a diagram illustrating a schematic configuration of the refrigerant circulation cycle.

The refrigerant circulation cycle mainly includes a production phase, a distribution phase, an installation phase, a maintenance phase, a recovery phase, and a regeneration phase. In FIG. 1, the flow of the refrigerant is indicated by arrows. The refrigerant is distributed in a state of filling a dedicated container such as a cylinder R1 or the refrigeration cycle apparatus 500. FIG. 1 illustrates a flow of the cylinder R1 filled with the refrigerant and the refrigeration cycle apparatus 500 filled with the refrigerant.

In the production phase, the refrigerant is newly produced by a refrigerant manufacturer. The refrigerant produced in the production phase fills the dedicated cylinder R1 and is shipped to a distributor of the refrigerant. Shipping destinations of the refrigerant are, for example, a manufacturer of a refrigerant using apparatus, such as the refrigeration cycle apparatus 500, an installer of the refrigerant using apparatus, and a maintainer of the refrigerant using apparatus. The manufacturer of the refrigerant using apparatus fills the refrigerant using apparatus with the refrigerant as necessary at the time of manufacturing or shipping of the refrigerant using apparatus.

In the distribution phase, the refrigerant newly produced in the production phase or the refrigerant regenerated in the regeneration phase is distributed by the distributor of the refrigerant. For example, the distributor purchases the refrigerant manufactured by the refrigerant manufacturer or the refrigerant regenerated by a regenerator, and sells the refrigerant to at least one of the manufacturer, the installer, and the maintainer of the refrigerant using apparatus.

In the installation phase, the installer installs the refrigeration cycle apparatus 500 in a predetermined installation location. The predetermined installation location is, for example, a property such as a building used or owned by an owner of the refrigeration cycle apparatus 500. The installer fills the refrigeration cycle apparatus 500 with the refrigerant distributed by the distributor at the time of installation of the refrigeration cycle apparatus 500.

In the maintenance phase, the maintainer performs maintenance management for the refrigeration cycle apparatus 500 installed. Specifically, the maintainer performs an inspection operation, a repair operation, or the like on the refrigeration cycle apparatus 500. The maintainer performs as appropriate a replacement operation for the refrigerant filling the refrigeration cycle apparatus 500 by using the cylinder R1 filled with the refrigerant, or a refilling operation of replenishing the refrigeration cycle apparatus 500 with the refrigerant. The refrigerant replacement operation is performed, for example, when a predetermined period of time elapses after the refrigeration cycle apparatus 500 is installed. The refrigerant refilling operation is performed, for example, when it is found at the time of inspection that the amount of the refrigerant filling the refrigeration cycle apparatus 500 is insufficient.

In the recovery phase, a refrigerant recycler recovers the refrigerant filling the refrigeration cycle apparatus 500 or filling the refrigeration cycle apparatus 500 and a refrigerant pipe installed in the property. The recycler recovers the refrigerant when the refrigeration cycle apparatus 500 is repaired, relocated, discarded, or the like. Methods of recovering the refrigerant include: a method of collecting and recovering the refrigerant filling the refrigerant pipe into the refrigeration cycle apparatus 500, a method of recovering the refrigerant in the refrigeration cycle apparatus 500 and the refrigerant pipe to accommodate the refrigerant in the dedicated cylinder R1, and the like. Also when replacing the refrigerant filling the refrigeration cycle apparatus 500, the recycler takes out and recovers the refrigerant from the refrigeration cycle apparatus 500.

In the regeneration phase, the refrigerant recovered by the recycler is subjected to regeneration processing by the refrigerant regenerator. The refrigerant regeneration processing is, for example, processing of regenerating the refrigerant by using the recovered refrigerant as a raw material and processing of removing impurities from the recovered refrigerant. The regenerator receives the cylinder R1 filled with the refrigerant to be regenerated from the recycler and regenerates the refrigerant. The regenerated refrigerant is accommodated in the cylinder R1.

(2) Detailed Configuration

Figure 2:
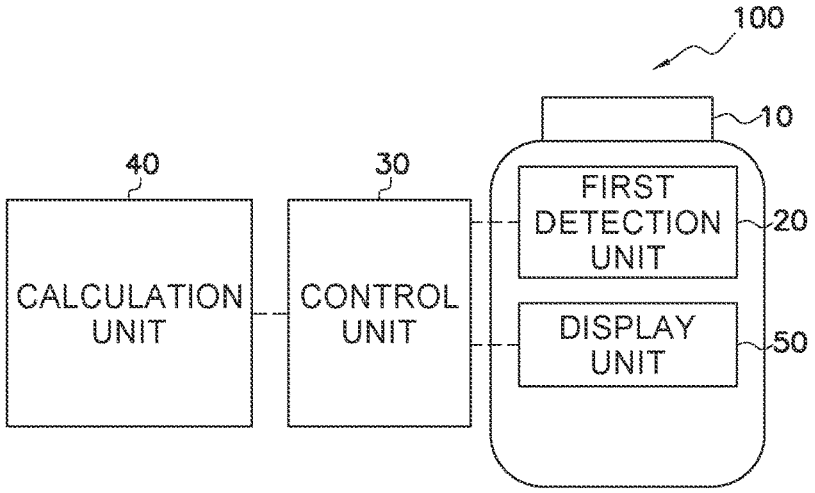
FIG. 2 is a diagram illustrating a schematic configuration of a refrigerant recovery system 100.

The refrigerant recovery system 100 includes a cylinder 10, a first detection unit 20, a control unit 30, a calculation unit 40, and a display unit 50. FIG. 2 is a diagram illustrating a schematic configuration of the refrigerant recovery system 100.

(2-1) Cylinder 10

The cylinder 10 is a container accommodating, for recovery, the refrigerant filling the refrigeration cycle apparatus 500. Specifically, the cylinder 10 corresponds to the cylinder R1 used between the maintenance phase or the recovery phase and the regeneration phase of the refrigerant circulation cycle.

(2-2) First Detection Unit 20

The first detection unit 20 detects a predetermined physical quantity for calculating a composition ratio of the refrigerant accommodated in the cylinder 10. In the present embodiment, in order to calculate a composition ratio of carbon dioxide in the refrigerant accommodated in the cylinder 10, the first detection unit 20 detects, as a predetermined physical quantity, the infrared absorptivity of the gas phase of the refrigerant accommodated in the cylinder 10. In the present embodiment, the first detection unit 20 is an infrared gas analyzer capable of measuring the infrared absorptivity of the gas phase.

(2-3) Control Unit 30

The control unit 30 acquires a result of detection by the first detection unit 20 and outputs the result as a first detection result. In the present embodiment, the control unit acquires the infrared absorptivity of the gas phase of the refrigerant detected by the first detection unit 20 and outputs the infrared absorptivity as the first detection result to the calculation unit 40. The control unit 30 acquires composition information, which is a calculation result, from the calculation unit 40. Upon receiving the composition information from the calculation unit 40, the control unit 30 causes the display unit 50 to display the composition information.

The control unit 30 is implemented by a computer. The control unit 30 includes a control calculation device and a storage device (both of which are not illustrated). A processor such as a CPU or a GPU is usable as the control calculation device. The control calculation device reads a program stored in the storage device and executes, based on the program, predetermined image processing and calculation processing. Furthermore, based on the program, the control calculation device may write a calculation result to the storage device and read information stored in the storage device.

(2-4) Calculation Unit 40

The calculation unit 40 calculates, based on the first detection result output from the control unit 30, composition information that is information related to the composition of the refrigerant accommodated in the cylinder 10. In the present embodiment, the calculation unit 40 calculates, as the composition information, the composition ratio of carbon dioxide accommodated in the cylinder 10 based on the infrared absorptivity of the gas phase of the refrigerant. The calculation unit 40 outputs the calculated composition information to the control unit 30. In the present embodiment, the calculation unit 40 is attached to the cylinder 10.

The calculation unit 40 is implemented by a computer as in the case of the control unit 30. The calculation unit 40 may be implemented by the same computer as the control unit 30, or may be implemented by another computer.

(2-5) Display Unit 50

The display unit 50 is a display medium that is attached to the cylinder 10 and displays predetermined information. The display unit 50 acquires the predetermined information from the control unit 30 and displays the predetermined information. In the present embodiment, the predetermined information displayed by the display unit 50 is the composition ratio of carbon dioxide accommodated in the cylinder 10 calculated by the calculation unit 40. Examples of the display unit 50 include, but not limited to, a liquid crystal display, an LED display, an electrophoretic display, and the like. The display unit is not necessarily attached to the cylinder 10. In this case, the display unit 50 may include a communication port, acquire the predetermined information from the control unit 30 through the communication port, and display the predetermined information.

(3) Overall Operation

Figure 3:
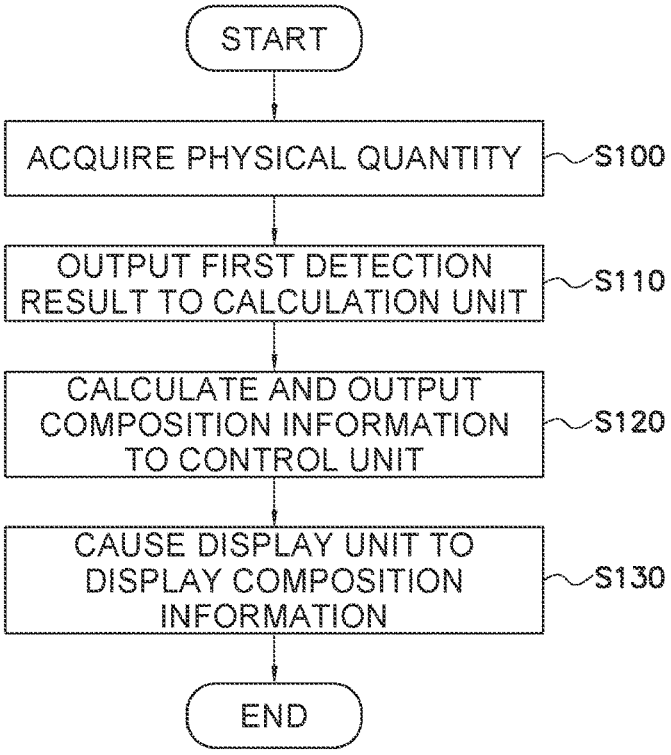
FIG. 3 is a flowchart of a flow of control executed by a control unit 30 and a calculation unit 40.

FIG. 3 is a flowchart of a flow of control executed by the control unit 30 and the calculation unit 40. The control flow in FIG. 3 starts when the control unit 30 and the calculation unit 40 are turned ON.

In step S100, the control unit 30 acquires the physical quantity (the infrared absorptivity of the gas phase of the refrigerant accommodated in the cylinder 10) detected by the first detection unit 20. Then, the processing proceeds to step S110.

In step S110, the control unit 30 outputs the detection result acquired from the first detection unit 20 to the calculation unit 40 as the first detection result. Then, the processing proceeds to step S120.

In step S120, the calculation unit 40 calculates the composition information (the composition ratio of the carbon dioxide accommodated in the cylinder 10) based on the first detection result, and outputs the composition information to the control unit 30. Then, the processing proceeds to step S130.

In step S130, the control unit 30 acquires the composition information and causes the display unit 50 to display the composition information, and ends the control flow.

The control flow described above is executed, for example, in the maintenance phase or the recovery phase of the refrigerant circulation cycle described above. Specifically, when the refrigerant of the refrigeration cycle apparatus 500 is recovered into the cylinder 10 in the maintenance phase or the recovery phase, the operator of the maintainer or the recycler starts executing the control flow in FIG. 3. When the control flow in FIG. 3 ends, the composition ratio of the carbon dioxide recovered into the cylinder is displayed on the display unit 50 attached to the cylinder 10.

(4) Features (4-1)

The refrigerant recovery system 100 includes the cylinder 10, the first detection unit 20, and the control unit 30. The cylinder 10 accommodates the refrigerant filling the refrigeration cycle apparatus 500. The first detection unit 20 detects the predetermined physical quantity for calculating the composition of the refrigerant accommodated in the cylinder 10. The control unit 30 acquires a result of detection by the first detection unit 20 and outputs the result as a first detection result.

Preferably, in the refrigerant circulation cycle, the refrigerant recovered from the refrigeration cycle apparatus 500 is directly reusable, without regeneration processing of newly adding or reducing the refrigerant. However, when the refrigerant is accommodated in the cylinder 10 from the refrigeration cycle apparatus 500 using the mixed refrigerant, the composition of the refrigerant may change due to, for example, partial leakage of the refrigerant. Thus, the recovery operation for reusing the refrigerant accommodated in the cylinder 10 is complicated because it is necessary to determine whether the refrigerant can be reused by measuring the composition of part of the refrigerant taken out from the cylinder 10.

In the refrigerant recovery system 100, the infrared absorptivity of the gas phase of the refrigerant accommodated in the cylinder 10 is detected by the first detection unit 20, and is output by the control unit 30 as the first detection result. Therefore, in the regeneration phase, it is possible to determine whether the refrigerant is reusable, by calculating the composition ratio of the refrigerant accommodated in the cylinder 10 with reference to the result output from the control unit 30, without taking out the refrigerant from the cylinder 10. Thus, the refrigerant recovery system 100 can suppress complication of the operation for reusing the refrigerant recovered from the refrigeration cycle apparatus 500.

(4-2)

The refrigerant recovery system 100 further includes the calculation unit 40. The calculation unit 40 calculates, based on the first detection result, composition information that is information related to the composition of the refrigerant accommodated in the cylinder 10.

With the calculation unit 40 provided, the refrigerant recovery system 100 can calculate the composition ratio of carbon dioxide, which is the composition information on the refrigerant accommodated in the cylinder 10, based on the infrared absorptivity, which is the first detection result, of the gas phase of the refrigerant accommodated in the cylinder 10. With this refrigerant recovery system 100, since the calculation unit 40 calculates the composition information, the operator can easily refer to the composition information on the refrigerant. Therefore, the complication of the operation for reusing the refrigerant recovered from the refrigeration cycle apparatus 500 can be more effectively suppressed.

(4-3)

The refrigerant recovery system 100 further includes the display unit 50. The display unit 50 is attached to the cylinder 10 and displays predetermined information. The control unit 30 causes the display unit 50 to display the composition information. In the refrigerant recovery system 100, the display unit 50 attached to the cylinder 10 is caused to display the composition information.

With this refrigerant recovery system 100, the operator can easily refer to the composition information on the refrigerant using the display unit 50. Therefore, the complication of the operation for reusing the refrigerant recovered from the refrigeration cycle apparatus 500 can be more effectively suppressed.

(4-4)

The physical quantity is the infrared absorptivity of the gas phase of the refrigerant accommodated in the cylinder 10. In the refrigerant recovery system 100, the control unit 30 outputs, as the first detection result, the infrared absorptivity of the gas phase of the refrigerant accommodated in the cylinder 10.

With this refrigerant recovery system 100, the composition ratio of the carbon dioxide contained in the refrigerant can be calculated based on the infrared absorptivity of the gas phase of the refrigerant.

(5) Modifications (5-1) Modification 1A

The information that the control unit 30 causes the display unit 50 to display is not limited to the composition information. In the refrigerant recovery system 100 according to Modification 1A, the control unit 30 refers to the composition information, and causes the display unit 50 to display first information upon determining that the proportion of the predetermined composition is not within a predetermined range. Specifically, the control unit 30 refers to the composition ratio of the carbon dioxide as the composition information, and upon determining that the composition ratio of the carbon dioxide is not within a range of an allowable proportion set in advance, causes the display unit 50 to display the first information.

Figure 4:
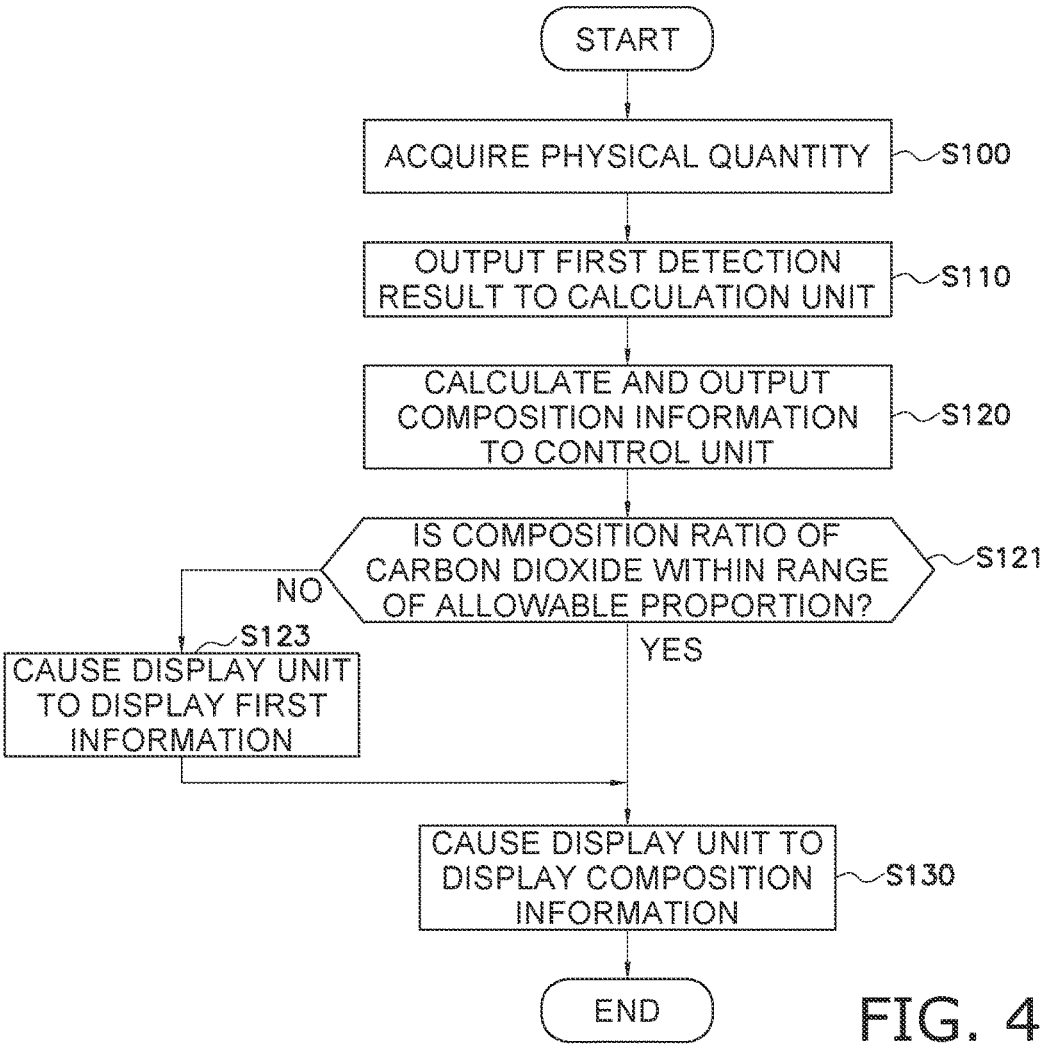
FIG. 4 is a flowchart of a flow of control executed by the control unit 30 and the calculation unit 40 of the refrigerant recovery system 100 according to Modification 1A.

FIG. 4 is a flowchart of a flow of control executed by the control unit 30 and the calculation unit 40 of the refrigerant recovery system 100 according to Modification 1A. The main difference between the control flow illustrated in FIG. 3 and the control flow illustrated in FIG. 4 is that the control flow illustrated in FIG. 4 includes step S121 and step S123. The difference will be mainly described below.

In step S120, the calculation unit 40 calculates the composition information (the composition ratio of the carbon dioxide accommodated in the cylinder 10) based on the first detection result, and outputs the composition information to the control unit 30. Then, the processing proceeds to step S121.

In step S121, the control unit 30 acquires the composition information and determines whether the composition ratio of the carbon dioxide is within the range of the allowable proportion. When the control unit 30 determines that the composition ratio of the carbon dioxide is within the range of the allowable proportion (Yes), the processing proceeds to step S130, whereas when the control unit 30 determines that the composition ratio of the carbon dioxide is outside the range of the allowable proportion (No), the processing proceeds to step S123.

More specifically, in step S121, the control unit 30 reads the allowable proportion of the carbon dioxide that is recorded in the storage device in advance, and compares the allowable proportion with the acquired composition information, to determine whether the composition ratio of the carbon dioxide is within the range of the allowable proportion. The range of the allowable proportion is a range of the composition ratio of the carbon dioxide at which the refrigerant accommodated in the cylinder 10 is reusable, without the regeneration processing of newly adding or reducing carbon dioxide in the regeneration phase of the refrigerant circulation cycle. The range of the allowable proportion of the carbon dioxide is, for example, 0.1% or more and 30% or less.

In step S123, the control unit 30 causes the display unit 50 to display the first information. Then, the processing proceeds to step S130. The first information is a warning informing the operator of the fact that the reuse is not an option unless the cylinder 10 is newly filled with the refrigerant because the carbon dioxide accommodated in the cylinder 10 is outside the range of the allowable proportion.

With this refrigerant recovery system 100, the operator can easily recognize whether the refrigerant filling the cylinder 10 can be reused. Therefore, the complication of the operation for reusing the refrigerant recovered from the refrigeration cycle apparatus 500 can be more effectively suppressed.

(5-2) Modification 1B

In the refrigerant recovery system 100 according to Modification 1B, the control unit 30 causes the display unit 50 to display an identification number set for the cylinder 10.

The identification number is, for example, a number that is individually set for each cylinder 10 by a refrigerant recycler in order to manage the cylinder 10 in the refrigerant circulation cycle. The identification number is recorded in the storage device of the control unit 30. The control unit 30 refers to the identification number recorded in the storage device and causes the display unit 50 to display the identification number.

With this refrigerant recovery system 100, the operator can easily refer to the composition information on the refrigerant and the identification number, using the display unit 50. Thus, with this refrigerant recovery system 100, the cylinder 10 and the composition information on the refrigerant accommodated in the cylinder 10 are easily associated with each other, whereby the complication of the operation for recovering the refrigerant from the refrigeration cycle apparatus 500 is more effectively suppressed.

(5-3) Modification 1C

The predetermined physical quantity for calculating the composition of the refrigerant detected by the first detection unit 20 is not limited to the infrared absorptivity of the gas phase of the refrigerant. The predetermined physical quantity may further include the temperature and the pressure of the refrigerant when accommodated in the cylinder 10.

In the refrigerant recovery system 100 according to Modification 1C, the first detection unit 20 includes, in addition to the infrared gas analyzer, a temperature sensor and a pressure sensor for measuring the temperature and the pressure of the refrigerant.

In the refrigerant recovery system 100 according to Modification 1C, in step S100 of the control flow illustrated in FIG. 3, the control unit 30 acquires, as physical quantities, the infrared absorptivity of the gas phase of the refrigerant and the temperature and the pressure of the refrigerant when accommodated in the cylinder 10. The control unit 30 outputs these physical quantities as the first detection result to the calculation unit in step S110. In step S120, the calculation unit 40 calculates, in addition to the infrared absorptivity of the gas phase of the refrigerant, the composition information on the refrigerant accommodated in the cylinder 10 using the temperature and the pressure of the refrigerant when accommodated in the cylinder 10.

With this refrigerant recovery system 100, the composition information can be calculated more accurately than in a case where the composition information is calculated based only on the infrared absorptivity of the gas phase of the refrigerant.

(5-4) Modification 1D

The predetermined physical quantity may further include a liquid refrigerant amount accommodated in the cylinder 10.

In the refrigerant recovery system 100 according to Modification 1D, the first detection unit 20 includes a liquid level sensor in addition to the infrared gas analyzer, the temperature sensor, and the pressure sensor. The liquid level sensor measures the height of the liquid level of the liquid refrigerant in the cylinder 10 to obtain the liquid refrigerant amount.

In the refrigerant recovery system 100 according to Modification 1D, in step S100 of the control flow illustrated in FIG. 3, the control unit 30 acquires, as physical quantities, the infrared absorptivity of the gas phase of the refrigerant, the temperature and the pressure of the refrigerant when accommodated in the cylinder 10, and the liquid refrigerant amount. The control unit 30 outputs these physical quantities as the first detection result to the calculation unit 40 in step S110. In step S120, the calculation unit calculates the composition information on the refrigerant accommodated in the cylinder using the liquid refrigerant amount, in addition to the infrared absorptivity of the gas phase of the refrigerant and the temperature and the pressure of the refrigerant when accommodated in the cylinder 10.

With this refrigerant recovery system 100, the composition information can be calculated further accurately than in a case where the composition information is calculated based on the infrared absorptivity of the gas phase of the refrigerant and the temperature and the pressure of the refrigerant when accommodated in the cylinder 10.

(5-5) Modification 1E

The control unit 30 may cause the display unit 50 to display the first detection result together with the composition information or instead of the composition information. In other words, the control unit 30 of the refrigerant recovery system 100 according to the Modification 1E outputs the detection result acquired from the first detection unit 20 to the display unit 50.

Second Embodiment (1) Overall Configuration refrigerant recovery system 110 according to a second embodiment implements the functions of the refrigerant recovery system 100 by using a processing server provided separately from the cylinder 10. The difference between the refrigerant recovery system 110 and the refrigerant recovery system 100 is that the refrigerant recovery system 110 includes a control unit 31 in place of the control unit 30 and a calculation unit 41 in place of the calculation unit 40, and in that the refrigerant recovery system 110 further includes a communication unit 60. Hereinafter, the refrigerant recovery system 110 will be described focusing on the differences from the refrigerant recovery system 100.

(2) Detailed Configuration

Figure 5:
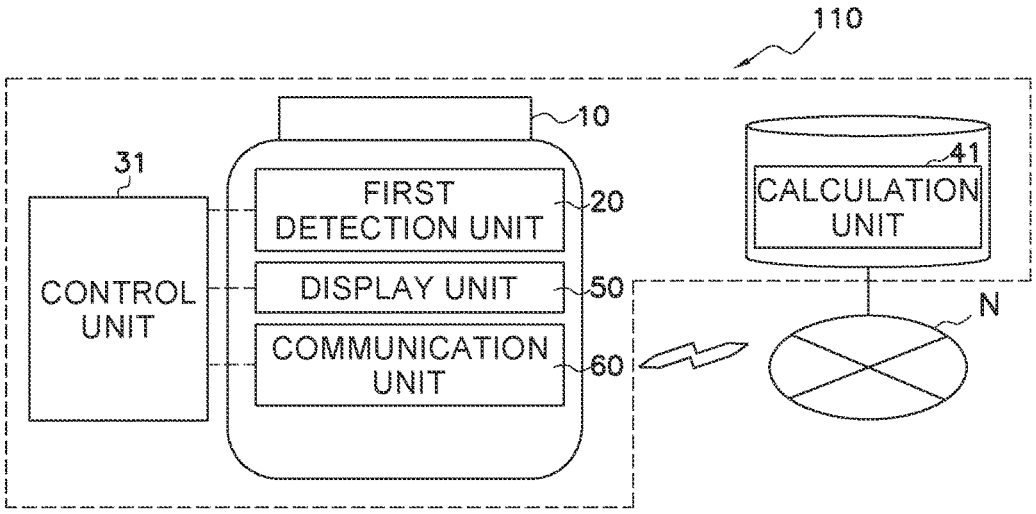
FIG. 5 is a diagram illustrating a schematic configuration of a refrigerant recovery system 110.

The refrigerant recovery system 110 includes the cylinder 10, the first detection unit 20, the control unit 31, the calculation unit 41, the display unit 50, and the communication unit 60. FIG. 5 is a diagram illustrating a schematic configuration of the refrigerant recovery system 110.

(2-1) Control Unit 31

The difference between the control unit 31 and the control unit 30 is that the control unit 31 outputs the first detection result to the communication unit 60 to transmit the first detection result to a network N. The control unit 31 acquires composition information, which is a calculation result of the calculation unit 41, via the communication unit 60. Upon receiving the composition information, the control unit 31 causes the display unit 50 to display the composition information.

(2-2) Calculation Unit 41

The difference between the calculation unit 41 and the calculation unit 40 is that the calculation unit 41 is not attached to the cylinder 10. The calculation unit 41 is coupled to the network N such as the Internet. The calculation unit 41 acquires the first detection result transmitted by the communication unit 60 from the network N using a communication device (not illustrated). As with the calculation unit 40, the calculation unit 41 calculates, upon receiving the first detection result, the composition information, which is information related to the composition of the refrigerant accommodated in the cylinder 10, based on the first detection result. The calculation unit 41 transmits the calculated composition information to the network N using the communication device (not illustrated). The calculation unit 41 is implemented by, for example, a processing server owned by the recycler, the maintainer, or the regenerator.

(2-3) Communication Unit 60

The communication unit 60 is a communication device that transmits the first detection result output from the control unit 31 and receives the composition information transmitted by the calculation unit 41. The communication unit 60 transmits the first detection result output from the control unit 31 to the network N using, for example, wireless communications. The communication unit 60 acquires the composition information calculated by the calculation unit 41 from the network N. The communication unit 60 is attached to the cylinder 10.

(3) Overall Operation

The difference in operation between the refrigerant recovery system 100 and the refrigerant recovery system 110 is that the exchange of the first detection result and the composition information between the control unit 31 and the calculation unit 41 in the refrigerant recovery system 110 is performed via the communication unit 60 and the network N. Since there is no difference from the control flow illustrated in FIG. 3 in other respects, a detailed description of the operation will be omitted.

(4) Features (4-1)

The refrigerant recovery system 110 further includes the communication unit 60 attached to the cylinder 10. The control unit 31 causes the communication unit 60 to transmit the first detection result.

In the refrigerant recovery system 110, for example, the first detection result obtained at the timing of accommodation of the refrigerant of the refrigeration cycle apparatus 500 in the cylinder 10 in the maintenance phase or the recovery phase can be transmitted to the regenerator from the communication unit 60. Thus, based on the first detection result obtained at the timing of accommodation of the refrigerant, the regenerator can obtain information indicating whether the refrigerant to be recovered is reusable without the regeneration processing, or processing such as refilling is required. Thus, the refrigerant recovery system 110 can more effectively suppress the complication of the operation for reusing a refrigerant accommodated from a refrigeration cycle apparatus 500.

(5) Modification (5-1) Modification 2A

In the refrigerant recovery system 110, the display unit 50 may also be provided to the calculation unit 41. Specifically, the display unit 50 may be provided to a processing server that implements the calculation unit 41.

Third Embodiment (1) Overall Configuration

A refrigerant recovery system 120 according to a third embodiment has a function of detecting a predetermined impurity in the refrigerant accommodated in the cylinder 10, in addition to the functions of the refrigerant recovery system 100. The difference between the refrigerant recovery system 120 and the refrigerant recovery system 100 is that the refrigerant recovery system 120 further includes a second detection unit 70 and includes a control unit 32 instead of the control unit 30. Hereinafter, the refrigerant recovery system 120 will be described focusing on the differences from the refrigerant recovery system 100.

(2) Detailed Configuration

Figure 6:
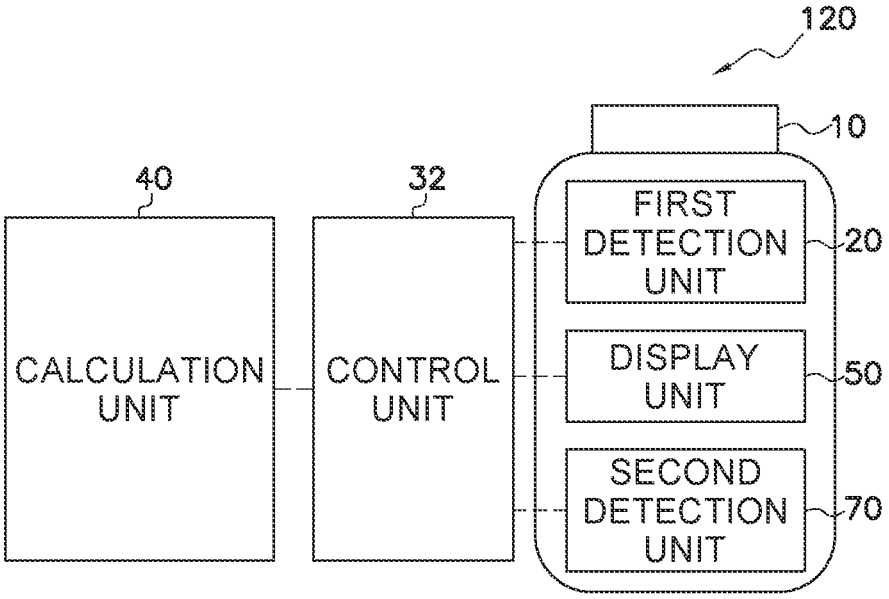
FIG. 6 is a diagram illustrating a schematic configuration of a refrigerant recovery system 120.

The refrigerant recovery system 120 includes the cylinder 10, the first detection unit 20, the control unit 32, the calculation unit 40, the display unit 50, and the second detection unit 70. FIG. 6 is a diagram illustrating a schematic configuration of the refrigerant recovery system 120.

(2-1) Second Detection Unit 70

The second detection unit 70 detects a predetermined impurity in the refrigerant accommodated in the cylinder 10. In the present embodiment, the impurity is moisture. The second detection unit 70 is a moisture sensor capable of detecting moisture contained in the refrigerant and outputs whether moisture is detected.

(2-2) Control Unit 32

The difference between the control unit 32 and the control unit 30 is that the control unit 32 acquires the result of detection by the first detection unit 20 and outputs the result as the first detection result to the calculation unit 40, and in addition, the control unit 32 causes the display unit to display second information when the second detection unit 70 detects the impurity.

The control unit 32 acquires composition information which is a calculation result from the calculation unit 40. Upon receiving the composition information from the calculation unit 40, the control unit 32 causes the display unit 50 to display the composition information.

(3) Overall Operation

Figure 7:
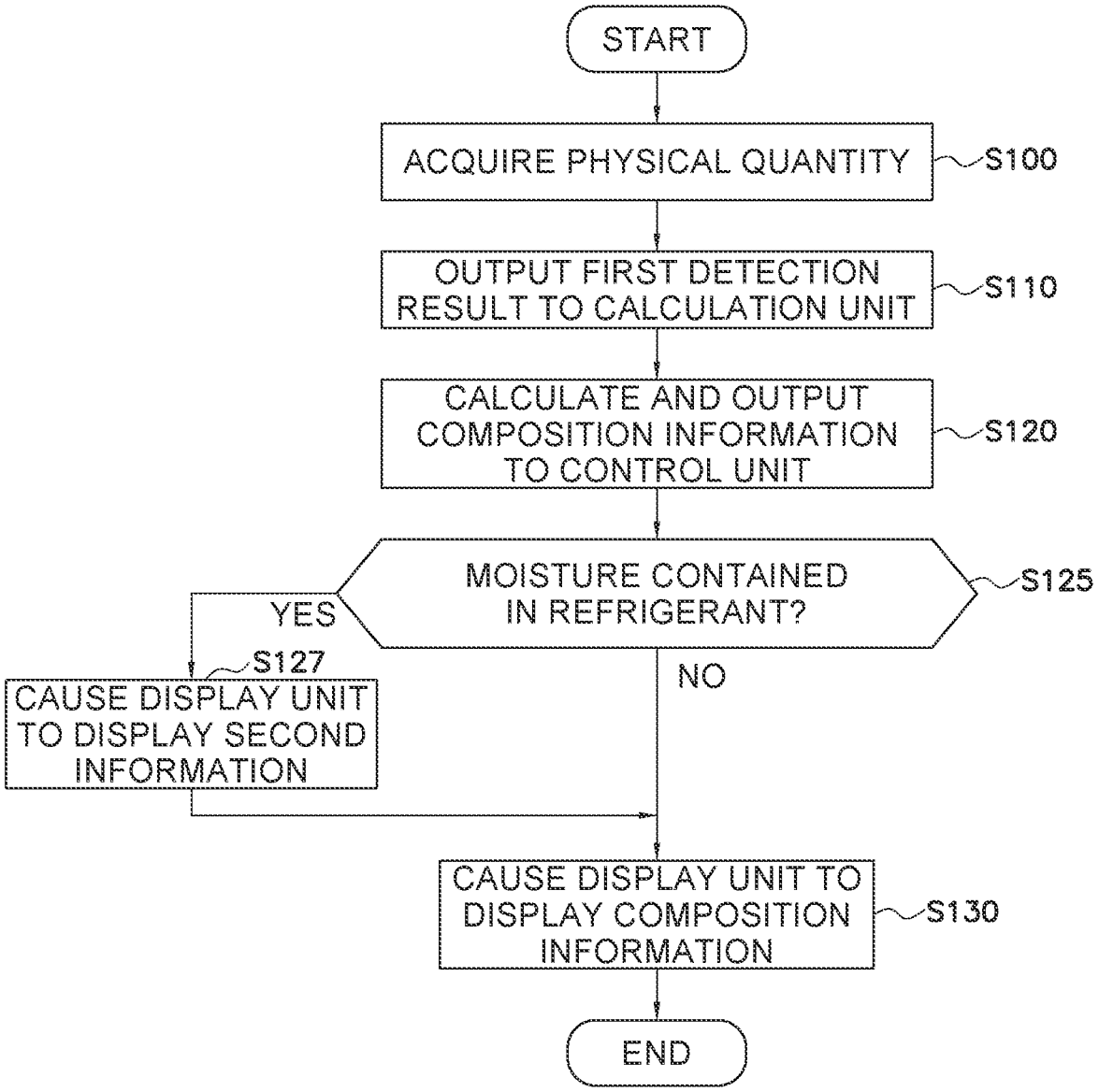
FIG. 7 is a flowchart of a flow of control executed by a control unit 32 and the calculation unit 40.

FIG. 7 is a flowchart of a flow of control executed by the control unit 32 and the calculation unit 40.

The difference between the control flow illustrated in FIG. 3 and the control flow illustrated in FIG. 7 is that the control flow illustrated in FIG. 7 includes step S125 to step S127. The difference will be mainly described below.

In step S120, the calculation unit 40 calculates the composition information on the refrigerant accommodated in the cylinder 10 based on the first detection result, and outputs the composition information to the control unit 32. Then, the processing proceeds to step S125.

In step S125, the control unit 32 acquires the result of detection by the second detection unit 70 and determines whether moisture as the impurity is contained in the refrigerant. When the impurity is contained in the refrigerant (Yes), the processing proceeds to step S127, whereas when the impurity is not contained (No), the processing proceeds to step S130.

In step S127, the control unit 32 causes the display unit 50 to output the second information. Then, the processing proceeds to step S130. The second information is a warning informing the operator of the fact that the direct reuse is not an option because the refrigerant accommodated in the cylinder 10 contains moisture.

(4) Features (4-1)

The refrigerant recovery system 120 further includes the second detection unit 70. The second detection unit 70 detects a predetermined impurity (moisture) contained in the refrigerant accommodated in the cylinder 10. The control unit 32 causes the display unit 50 to display the second information when the second detection unit 70 detects moisture.

With the refrigerant recovery system 120, the operator can learn, without taking out the refrigerant from the cylinder 10, whether impurities are present in addition to the composition information on the refrigerant. Thus, the refrigerant recovery system 120 can more effectively suppress the complication of the operation for reusing the refrigerant accommodated from the refrigeration cycle apparatus 500.

(5) Modification (5-1) Modification 3A

The impurity detected by the second detection unit 70 is not limited to moisture as long as the impurity is a substance that is not preferable to be contained in the refrigerant. The second detection unit 70 of the refrigerant recovery system 120 according to Modification 3A detects the air as an impurity.

While embodiments of the present disclosure have been described above, it should be understood that various changes in mode and detail may be made without departing from the spirit and scope of the present disclosure as set forth in the claims.

The invention claimed is:

1. A refrigerant recovery system comprising:

a cylinder configured to accommodate a refrigerant filling a refrigeration cycle apparatus;

a first detection unit configured to detect a predetermined physical quantity in order to calculate a composition of the refrigerant accommodated in the cylinder, the first detection unit including a first sensor;

an electronic controller configured to acquire a result of detection by the first detection unit and output the result as a first detection result;

a calculation unit configured to calculate, based on the first detection result, composition information related to the composition of the refrigerant accommodated in the cylinder; and a display unit attached to the cylinder the display unit including a display and being configured to display predetermined information, the electronic controller being configured to cause the display unit to display the first detection result or the composition information.

2. The refrigerant recovery system according to claim 1, wherein the electronic controller is configured to refer to the composition information, and cause the display unit to display first information upon determining that a proportion of a predetermined composite is not within a predetermined range.

3. The refrigerant recovery system according to claim 1, further comprising:

a communication unit attached to the cylinder, the electronic controller being configured to cause the communication unit to transmit the first detection result.

4. The refrigerant recovery system according to claim 1, wherein the electronic controller is configured to cause a display unit to display an identification number set for the cylinder.

5. The refrigerant recovery system according to claim 1, wherein the predetermined physical quantity is an infrared absorptivity of a gas phase of the refrigerant accommodated in the cylinder.

6. The refrigerant recovery system according to claim 5, wherein the predetermined physical quantity further includes a temperature and a pressure of the refrigerant when accommodated in the cylinder.

7. The refrigerant recovery system according to claim 6, wherein the predetermined physical quantity further includes a liquid refrigerant amount of the refrigerant accommodated in the cylinder.

8. The refrigerant recovery system according to claim 1, further comprising:

a second detection unit configured to detect a predetermined impurity contained in the refrigerant accommodated in the cylinder, the second detection unit including a second sensor, the electronic controller being configured to cause a display unit to display second information when the second detection unit detects the impurity.

9. The refrigerant recovery system according to claim 8, wherein the impurity is air or water.

10. The refrigerant recovery system according to claim 3, wherein the electronic controller is configured to cause a display unit to display an identification number set for the cylinder.

11. The refrigerant recovery system according to claim 3, wherein the predetermined physical quantity is an infrared absorptivity of a gas phase of the refrigerant accommodated in the cylinder.

12. The refrigerant recovery system according to claim 3, further comprising:

a second detection unit configured to detect a predetermined impurity contained in the refrigerant accommodated in the cylinder, the electronic controller being configured to cause a display unit to display second information when the second detection unit detects the impurity.

* * * * *